US008528732B2

(12) United States Patent
Westhovens et al.

(10) Patent No.: US 8,528,732 B2
(45) Date of Patent: Sep. 10, 2013

(54) CONTAINER

(75) Inventors: Ivo Westhovens, Genk (BE); Damien Moran, Northants (GB)

(73) Assignee: Carglass Luxembourg Sarl-Zug Branch, Zug (CH)

( * ) Notice: Subject to any disclaimer, the term of this patent is extended or adjusted under 35 U.S.C. 154(b) by 707 days.

(21) Appl. No.: 10/599,610

(22) PCT Filed: Apr. 6, 2005

(86) PCT No.: PCT/GB2005/001327

§ 371 (c)(1),
(2), (4) Date: May 1, 2007

(87) PCT Pub. No.: WO2005/097624

PCT Pub. Date: Oct. 20, 2005

(65) Prior Publication Data

US 2007/0295630 A1 Dec. 27, 2007

(30) Foreign Application Priority Data

Apr. 6, 2004 (GB) ..... 0407810.1

(51) Int. Cl.
*B65D 85/48* (2006.01)

(52) U.S. Cl.
USPC ..... 206/448; 206/449; 206/451; 206/454

(58) Field of Classification Search
USPC ..... 206/448, 449, 451, 454, 386, 595–600; 211/41.14; 410/75, 121, 150, 130; 220/1.5
See application file for complete search history.

(56) References Cited

U.S. PATENT DOCUMENTS

| | | | | | |
|---|---|---|---|---|---|
| 2,070,586 | A | | 2/1937 | Fitch | |
| 2,156,876 | A | | 5/1939 | Scull | |
| 2,575,751 | A | * | 11/1951 | Donnelley | 410/149 |
| 3,040,925 | A | * | 6/1962 | Mills | 220/1.5 |
| 3,382,998 | A | * | 5/1968 | Turpen | 220/1.5 |
| 3,809,234 | A | | 5/1974 | Kurick | |
| 3,887,071 | A | | 6/1975 | Thomaswick | |
| 3,938,660 | A | * | 2/1976 | Moehring | 206/451 |
| 3,963,122 | A | | 6/1976 | Pater et al. | |
| 3,995,738 | A | | 12/1976 | Rowley et al. | |
| 4,074,823 | A | | 2/1978 | Pater et al. | |
| 4,278,171 | A | * | 7/1981 | Millhoan | 206/451 |
| 4,695,211 | A | * | 9/1987 | Van Iperen et al. | 410/77 |
| 4,735,310 | A | | 4/1988 | Lemery et al. | |
| 4,789,281 | A | * | 12/1988 | Westerdale | 410/29.1 |

(Continued)

FOREIGN PATENT DOCUMENTS

| | | |
|---|---|---|
| DE | 8107930 | 3/1981 |
| DE | 3511258 | 10/1986 |

(Continued)

*Primary Examiner* — J. Gregory Pickett
*Assistant Examiner* — Kaushikkumar Desai
(74) *Attorney, Agent, or Firm* — Gordon & Jacobson, PC

(57) ABSTRACT

A container for transportation and/or storage of items is in the form of an enclosure having a securing arrangement with an upright restraint configured to be advanced and retracted across the width of the container for holding the items in an upright orientation; and/or access to the enclosure provided through an uppermost portion and end portion of the container, and a movable side panel proximate an end of the container; and/or spaced slide elements extending in the direction of the width of the container, in the region of the bottom of the container.

32 Claims, 3 Drawing Sheets

(56) References Cited

U.S. PATENT DOCUMENTS

| | | | | |
|---|---|---|---|---|
| 5,082,404 | A * | 1/1992 | Stewart et al. | 410/127 |
| 5,141,114 | A | 8/1992 | Cate | |
| 5,145,073 | A | 9/1992 | Kitagawa et al. | |
| 5,265,748 | A * | 11/1993 | Furukawa | 220/1.5 |
| 5,297,485 | A * | 3/1994 | Bond | 108/55.1 |
| 5,404,821 | A * | 4/1995 | Bond | 108/55.1 |
| 5,911,179 | A | 6/1999 | Spiczka | |
| 5,944,464 | A * | 8/1999 | Cole, Jr. | 410/153 |
| 5,960,959 | A | 10/1999 | Wu et al. | |
| 6,182,849 | B1 * | 2/2001 | Elstone, Sr. | 220/6 |
| 6,381,977 | B1 * | 5/2002 | Austin, Jr. | 62/259.1 |
| 6,691,885 | B2 * | 2/2004 | Brown | 220/7 |
| 7,270,236 | B2 * | 9/2007 | Angeletti et al. | 206/448 |
| 2002/0090276 | A1 * | 7/2002 | Earle et al. | 410/121 |
| 2003/0106822 | A1 | 6/2003 | Langh | |
| 2003/0164318 | A1 * | 9/2003 | Lacasse et al. | 206/448 |
| 2003/0219323 | A1 | 11/2003 | Shoup | |
| 2005/0077292 | A1 * | 4/2005 | Devine | 220/6 |

FOREIGN PATENT DOCUMENTS

| | | |
|---|---|---|
| DE | 9000968 | 4/1990 |
| DE | 4041622 | 6/1992 |
| DE | 4127371 | 2/1993 |
| DE | 4402191 | 7/1995 |
| DE | 195 08 955 | 9/1996 |
| GB | 2329378 | 3/1999 |
| JP | 7267290 | 10/1995 |
| JP | 09188327 | 7/1997 |
| JP | 2003137287 | 5/2003 |
| WO | WO 94/26626 | 11/1994 |
| WO | WO 03/090589 | 11/2003 |

* cited by examiner

CONTAINER

BACKGROUND OF THE INVENTION

The present invention relates to a container and in particular to a container suited for the transportation and/or storage of sheet items, particularly fragile, delicate or non uniform shape such items such as, for example, vehicle windscreens (which should be interpreted broadly to cover other vehicle glazing panels, such as rearscreens).

SUMMARY OF THE INVENTION

According to the present invention, there is provided a container for transportation and/or storage of items, the container comprising an enclosure and;

- a securing arrangement comprising an upright restraint configured to be advanced and retracted across the width of the container for holding the items in an upright orientation; and/or,
- access provided through an uppermost portion and end portion of the container, and an access arrangement comprising a movable side panel proximate an end of the container; and/or;
- a plurality of spaced slide elements extending in the direction of the width of the container, in the region of the bottom of the container.

The enclosure is preferably an elongate enclosure.

It is preferred that the container is of frame construction, preferably metallic frame construction.

Beneficially, the container has one or more openable or open ends. In one embodiment the container has a closed end panel. Desirably the container has an openable or open top. In a preferred embodiment the container has an open top and an open end opposite a closed end.

The side panel proximate the access permitting end of the container is preferably movable to open the end side portion of the container. The side panel is preferably movable by being pivotable. In a preferred embodiment, side panels on opposed sides of the container are movable to open respective end side portions of the container. Beneficially, movable side panels on opposed sides of the container are positioned proximate opposed ends of the container.

A lower portion of the container desirably includes frame openings for receiving tines or the like of lifting apparatus.

Beneficially, the upper and lower portions of the container are provided with stacking formations enabling stacking of containers one on top of another.

It is preferred that the upright restraint of the securing arrangement extends upwardly for the major extent of the height of the container. Beneficially, the securing arrangement includes support means mounting the upright restraint, and facilitating ease of movement of the upright restraint in the width direction of the container. The upright restraint is preferably supported to be movable on a rotatable support arrangement, such as wheels, rollers or the like, and/or constrained to move along a track or the like.

A lock arrangement is beneficially provided for locking the upright restraint at a selected position across the width of the container. In one embodiment the lock arrangement includes a series of spaced lock position locators for locking the upright restraint at one or more of a defined series of positions across the width of the container.

It is preferred that the upright restraint carries at least one contact member for contacting the adjacent item in the container. Beneficially, an adjustment arrangement is provided for urging the contact member into securing engagement with the adjacent item in the container. Desirably, the contact member is angularly reorientatable/adjustable relative to the upright restraint. The contact member advantageously comprises a flexible or resilient contact layer for contacting the adjacent item in the container. In a preferred embodiment a contact member arrangement includes upper and lower contact members carried by the upright restraint.

Preferably, a contact member or members is mounted to the container spaced from and facing the contact member or members carried by the upright restraint. The contact members carried by the container are preferably angularly adjustable/reorientatable with respect to the container.

It is preferred that one or more contact members are height adjustable with respect to the container.

It is preferred that the upright restraint comprises an upstand, which is preferably mounted to move on a base. The upstand may comprise a post or frame post.

Slide elements are preferably provided at opposed sides of the upright restraint. Slide elements preferably extend across the width of the container at the foot of the container. Beneficially, a slide element is provided across the access permitting end of the container. One or more (preferably all) slide elements include a hard and/or friction reducing surface layer promoting sliding of the items during loading or unloading of the container.

It is preferred that the container includes a securing element arranged to lie in engagement with the underside of the items in the container.

In use, the container is beneficially used for transportation and/or storage of a plurality of sheet items in upright orientation. In a specific embodiment the container is used for transportation and/or storage of a plurality of glass sheets in upright orientation. The container is particularly beneficially used to contain a number of differently configured vehicle windscreens.

In one embodiment a container as herein defined may be used to contain a number of sheet items in upright orientation, the container being mounted atop a further container including side doors permitting accessing of the interior of the further container.

The invention will now be further described, by way of example only and with reference to the accompanying drawings.

DETAILED DESCRIPTION OF THE PREFERRED EMBODIMENTS

Figure 1:
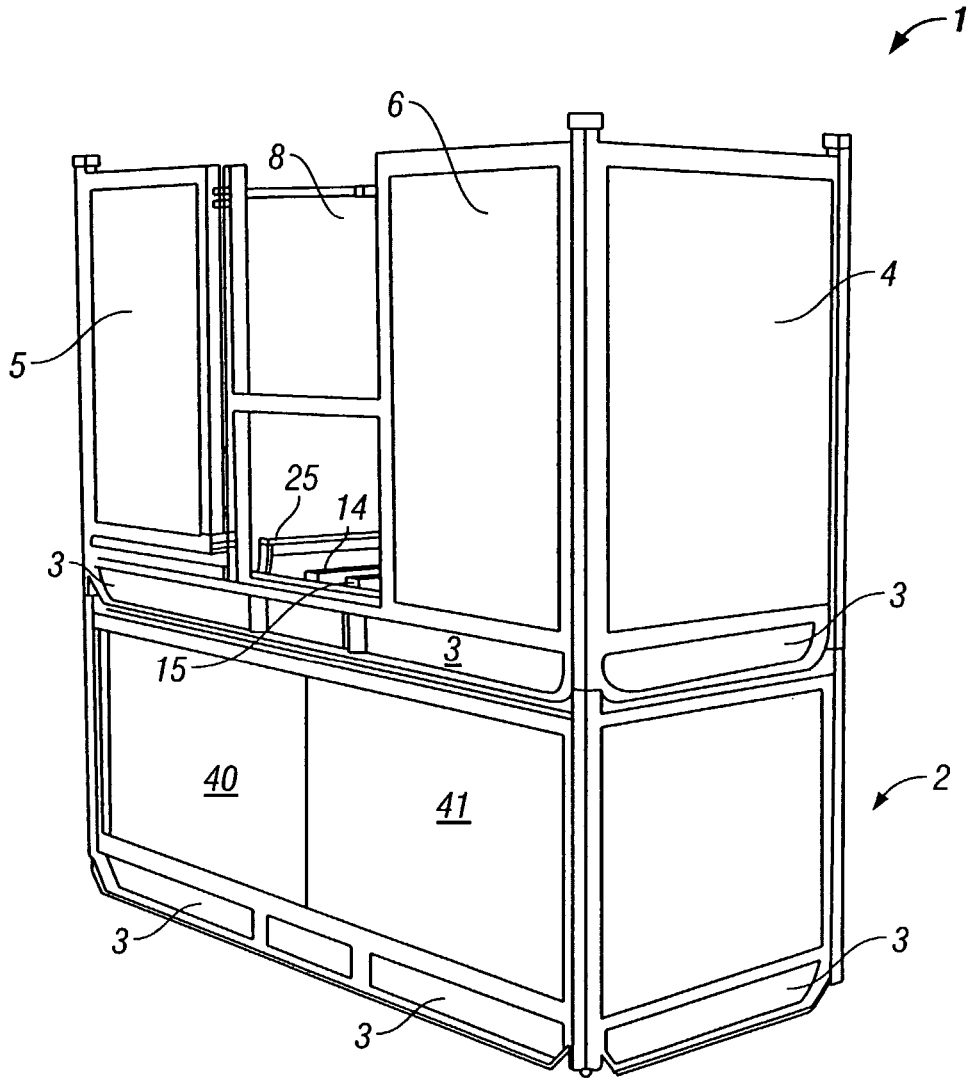
FIG. 1 is a side view of an exemplary (upper) container according to the invention mounted atop a (lower) container in the container combination according to the invention.

Referring to the drawings, there is shown in FIG. 1 a container 1 for use in transporting vehicle windscreens. The container will be described primarily in this context, although it should be readily appreciated that the invention extends to containers for transporting other fragile items, particularly other fragile sheet items.

The container 1 is of welded tubular frame construction and demountably mounted atop a similarly constructed lower container 2. Both upper and lower containers 1,2 include openings 3 in their respective frames to accommodate tines of lift/transport apparatus such as fork lift apparatus.

The upper container 1 is provided in accordance with the invention. The container 1 includes an open top and a closed end wall 4. The end opposite the closed end may be open. The sides of the container 1 include side panels 5,6,7,8 one or more of which may comprise movable doors, the purpose of which will be described in detail hereafter. For example in the embodiment shown in the drawings, doors 5 and 7 pivot on respective support posts to effectively open respective corners of the container, thereby to enhance access to the ends of the container for loading or unloading of the container. Door 5, for example is mounted by means of pivot mountings 66,67 to support post 68.

Spanning the width at the base of container 1 are three slide bars 9,10, 61 each having low friction hard upper surfaces. A further slide bar 62 is fixed at the bottom of the container adjacent openable door panel 5. The purpose of the slide bars 9, 10, 61 and 62 is to engage and support the lower edge of the windscreen during loading and unloading of the container. The glass is moved to slide over the upper surface of the bars. The upper surface of the bars may comprise a low friction material such as PTFE.

A central securing column 11 is mounted on support rollers 12 which are constrained to roll along rails 52, 53 spanning the opposed sides of the container 1. Inwardly of and alongside rails 52, 53 extend respective securing bars 14,15 including a series of spaced securing holes 16 along their length. The column 11 carries a plate 55 having at its foot respective securing bolts (not shown) which are spring biassed to engage through plate 55 within the holes 16. In this way column 11 can be moved in the width direction of the container and secured in position at the desired location. This facilitates loading and unloading the container and also makes the container adaptable to carry differing quantities of windscreens or windscreens of differing size and curvature configuration.

Figure 2:
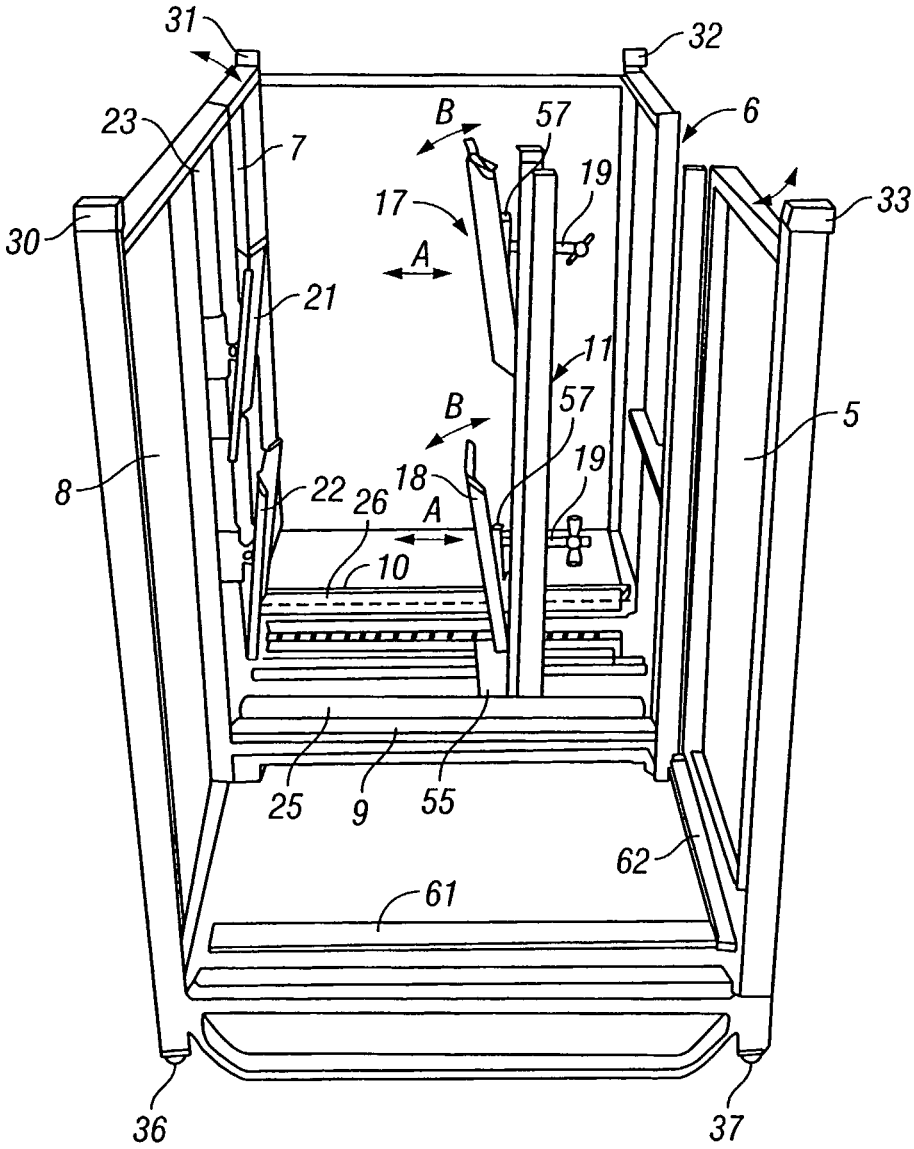
FIG. 2 is an end view of the (upper) container of FIG. 1.
Figure 3:
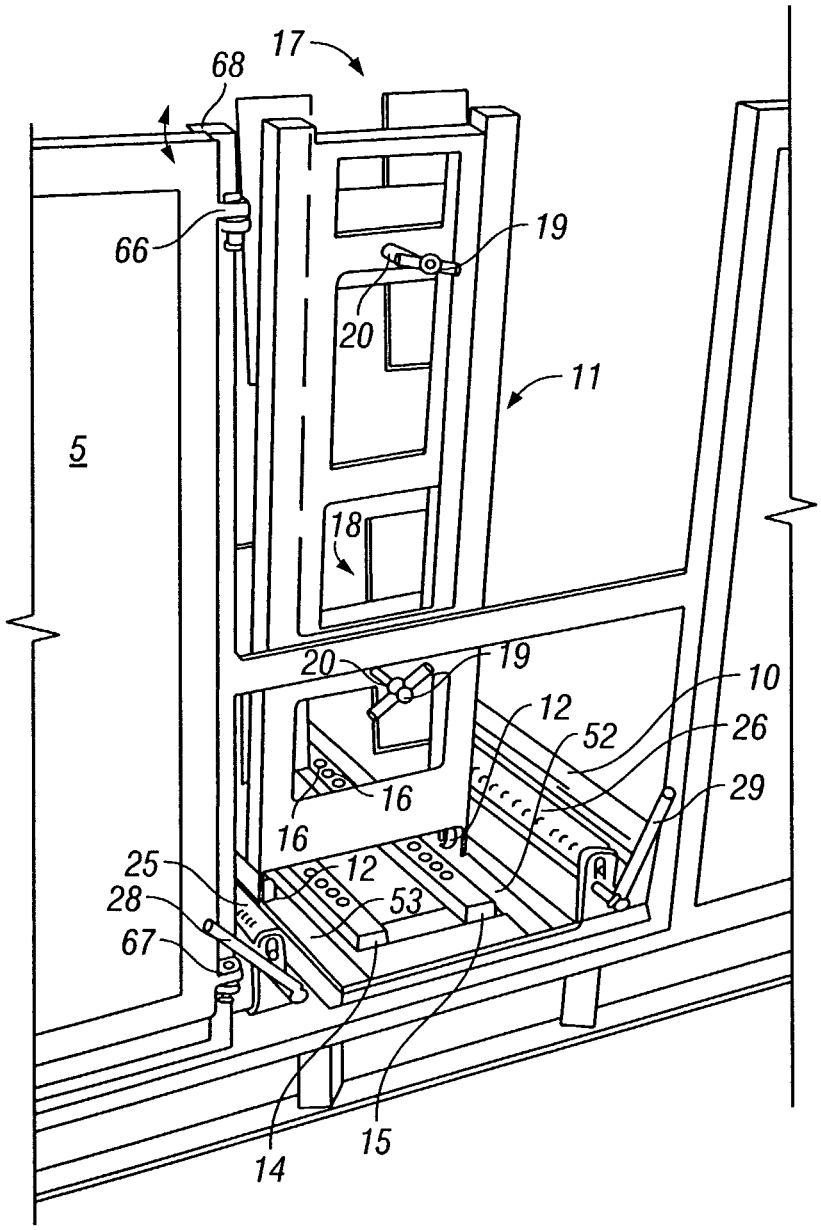
FIG. 3 is a detail view of a part of the (upper) container of the preceding figures.

The movable column 11 provides a coarse adjustment for securing the windscreens in position. The arrangement additionally includes a fine adjustment system for final securing of the windscreens in the container. In the embodiment shown the arrangement includes upper and lower pairs of paddles 17, 18 mounted tiltably to the column 11. The paddles 17, 18 are provided with conformable face layers (for example of polyurethane foam pads) to engage the adjacent windscreen, and may be mounted to the column 11 by means of respective ball mountings giving the paddles the facility to tilt in 2 planes. This provides a great deal of flexibility for securing, however paddles tilting about a single pivot axis have been found to work satisfactorily in most situations. Such an arrangement is shown in the drawings in which the paddle pairs 17,18 are mounted to a tilt mount 57 to tilt in the vertical plane as shown by arrows B in FIG. 2. The paddles are movable into and out of approachment with the windscreens present in the container by means of actuating in rotary fashion handles 19 to rotate a threaded shaft 20 threadably mated in a threaded bore in the column 11. This causes paddle pairs 17,18 and respective tilt mounts 57 to advance or retreat across the width of the container as shown by arrows A in FIG. 2.

It is greatly preferred that the fine securing adjustment system includes means for limiting the securing force applied by the paddles. This can be achieved in a number of ways, for example by using mechanical means such as torque limiting clutch arrangements or by use of load or pressure sensors to indicate when maximum permissible force has been applied. This results in less likelihood of inexperienced or careless operators overstressing and potentially damaging the windscreens in the container, or conversely failing to secure the windscreens adequately in the container.

The side of the container opposite the column 11 is provided with complementary pairs of paddles 21, 22 tiltably mounted to a post 23 at the side of the container. The paddles may be height adjustable on the column 11 or post 23. In the arrangement shown the paddles 21, 22 are height adjustable on brackets 24 mounted to post 23.

The container additionally includes a brake system intended to restrict longitudinal movement of windscreens present in the container. The brake system is re-configurable between a brake engaged condition and a brake released condition. The brake arrangement comprises a pair of brake bars 25,26 running alongside the slide bars 9, 10 so as to be positioned below the edge of the windscreens present. In the brake release configuration, the upper surfaces of the brake bars 25,26 are positioned below the level of the upper surface of the slide bars 9,10. This permits the lower edges of the windscreens to slide over the upper surface of the slide bars 9,10 without hindrance from the brake bars 25,26. In the brake engaged configuration, the brake bars are raised such that the upper surfaces of the brake bars engage the lower edges of the windscreens present. In the brake engaged position, the upper surface of the brake bars 25, 26 will typically be positioned just above the upper surface level of the slide bars 9,10.

In the embodiment shown, reconfiguration of the brake system between the engaged and released configurations is achieved by means of respective lever and cam arrangements for the brake bars 25,26. Levers 28,29 are operated to rotate a shaft below the bars 25,26, the shaft including offset cams which raise or lower the bars 25,26 dependent upon the rotary position of the shaft.

The upper surface of the brake bars is beneficially of friction enhancement or grip enhancement material. A conformable pad layer of rubber or other such like grip material may be provided for this purpose.

The container unit is provided with upper and lower corner mounting bosses 30 to 37 permitting like container units to be stacked one on top of the other, or alternative container units to be stacked. In a preferred embodiment of the invention the windscreen container unit may be stacked on top of a container unit used for storing other fitting materials. This arrangement is shown in FIG. 1, in which the windscreen storage unit 1 is mounted on top of a container unit 2 for storing other handling or fitting items. The lower container unit 2 includes slide doors 40, 41 for accessing the interior of the container 2.

In use the container can be conveniently loaded in a warehouse or other environment. The lower fork lift tine receptor openings 3, make the container particularly suitable for this purpose. The slide bars enable the windscreens to be readily positioned longitudinally. The openable end side doors provide enhanced operator access. The movable column can be retracted from the opposed wall in stages as the container is loaded. The paddles are then urged into securing engagement without overstressing the windscreens. This secures the windscreens from movement in the width direction of the container. The brake system can then be activated to engage the brake bars with the underside of the windscreens. This secures the package of screens against longitudinal movement. Containers may then be stacked for optimum space conservation during transport. Typically soft packaging material will be positioned intermediately between adjacent windscreens. At the unloading location, the brake system can be disengaged and the paddles released. The open top, end, and openable end side door permits any individual screen from the batch to be readily retrieved by operators.

The container is particularly suitable for use for transportation and/or storage of a batch of different size and or shape (for example curvature) windscreens, due to the flexibility of re-configuration of the container, the securing against both longitudinal and transverse movement of the windscreens and the facility to guard against over or under tightening of the transverse securing mechanism.

The invention claimed is:

1. A container for transportation and/or storage of items, the container comprising:

a base frame having a generally rectangular shape with four corners;

an enclosure supported above the base frame and having a length and a width and an open top, the enclosure defining two end portions that are disposed opposite one another along the length of the enclosure, the two end portions each bounded by a corresponding pair of corners of the base frame;

a securing arrangement, disposed within the enclosure, comprising an upright restraint configured to be advanced and retracted across the width of the enclosure for holding the items in an upright orientation; and an access arrangement, enabling placing items into the enclosure or removing items from the enclosure, the access arrangement providing access to at least one of the two end portions of the enclosure, the access arrangement comprising a first movable side panel disposed proximate a given end portion of the two end portions of the enclosure;

said first moveable side panel being pivotable about a first vertical pivot axis provided on a first vertical support member that extends upward from the base frame from a location intermediate first and second corners of the base frame, the first corner belonging to the pair of corners that bounds the given end portion of the enclosure, and the second corner belonging to the pair of corners that bounds the other end portion of the enclosure, wherein the first moveable side panel has a side disposed adjacent the first corner of the base frame in a closed configuration, whereby the pivoting movement of the first moveable side panel about the first vertical pivot axis renders open the given end portion of the enclosure at the first corner of the base frame; and said first movable side panel having a top edge that defines a portion of the open top of the enclosure in the closed configuration of the first moveable side panel.

2. A container according to claim 1, wherein:

the securing arrangement is disposed centrally between the two end portions of the enclosure.

3. A container according to claim 1, wherein:

at least one of the two end portions of the enclosure has a closed end wall that extends from the base frame across the width of the enclosure.

4. A container according to claim 1, wherein:

at least one of the two end portions of the enclosure has an open end that extends across the width of the enclosure.

5. A container according to claim 1, wherein:

the base frame has openings that accommodate tines of a lift apparatus.

6. A container according to claim 1, wherein:

the first moveable side panel is configured to pivot outwardly about the first vertical pivot axis provided on the first vertical support member.

7. A container according to claim 1, wherein:

the access arrangement further includes a second movable side panel disposed proximate the other end portion of the enclosure, said second moveable side panel being pivotable about a second vertical pivot axis provided on a second vertical support member that extends upward from the base frame from a location intermediate third and fourth corners of the base frame, the third corner belonging to the pair of corners that bounds the other end portion of the enclosure, and the fourth corner belonging to the pair of corners that bounds the given end portion of the enclosure, wherein the second moveable side panel has a side disposed adjacent the third corner of the base frame in a closed configuration, whereby the pivoting movement of the second moveable side panel about the second vertical pivot axis renders open the other end portion of the enclosure at the third corner of the base frame.

8. A container according to claim 7, wherein:

the second moveable side panel is configured to pivot outwardly about the second vertical pivot axis provided on the second vertical support member.

9. A container according to claim 1, wherein:

the enclosure has an openable or open top.

10. A container according to claim 1, wherein:

the base frame and upper portions of the enclosure are provided with stacking formations enabling stacking of containers one on top of another.

11. A container according to claim 1, wherein:

the upright restraint of the securing arrangement extends in an upright orientation for the major extent of the height of the enclosure.

12. A container according to claim 1, wherein:

the securing arrangement includes support means mounting the upright restraint, and facilitating ease of movement of the upright restraint along the width of the enclosure.

13. A container according to claim 12, wherein:

the upright restraint is at least one of (i) supported to be movable on a rotatable support arrangement and (ii) constrained to move along a track.

14. A container according to claim 1, further comprising:

a lock arrangement for locking the upright restraint at a selected position across the width of the enclosure.

15. A container according to claim 14, wherein:

the lock arrangement includes a series of spaced lock position locators for locking the upright restraint at one or more of a defined series of positions across the width of the enclosure.

16. A container according to claim 1, wherein:

the upright restraint carries at least one contact member for contacting an adjacent item in the enclosure.

17. A container according to claim 16, further comprising:

an adjustment arrangement for urging the contact member into securing engagement with the adjacent item in the enclosure.

18. A container according to claim 16, wherein:

the at least one contact member is angularly adjustable relative to the upright restraint.

19. A container according to claim 16, wherein:

the at least one contact member comprises a flexible or resilient contact layer for contacting the adjacent item in the enclosure.

20. A container according to claim 16, further comprising:

a contact member arrangement including upper and lower contact members carried by the upright restraint.

21. A container according to claim 16, wherein:

the at least one contact member is mounted within the enclosure spaced from and facing the upright restraint.

22. A container according to claim 16, wherein:
the at least one contact member is angularly adjustable with respect to the container.

23. A container according to claim 16, wherein:
the at least one contact member is at least one of height adjustable and reorientatable with respect to the container.

24. A container according to claim 1, further comprising:
slide elements provided at opposed sides of the upright restraint.

25. A container according to claim 1, further comprising:
a slide element provided across the given end portion of the enclosure.

26. A container according to claim 14, wherein:
the slide element includes a friction reduced surface layer promoting sliding of the items during loading or unloading.

27. A container according to claim 1, further comprising:
a securing element arranged to lie in engagement with the underside of the items in the enclosure.

28. A container according to claim 1, further comprising:
a plurality of sheet items in upright orientation contained therein for transportation or storage thereof.

29. A container according to claim 28, wherein:
the sheet items are glass sheets.

30. A container according to claim 29, wherein:
the glass sheets include a number of differently configured vehicle windscreens.

31. A container according to claim 1, further comprising:
a plurality of spaced slide elements extending along the width of the enclosure in the region of the bottom of the enclosure.

32. A container according to claim 11, wherein:
the first moveable side panel comprises a door.

* * * * *